United States Patent [19]

Wetzel et al.

[11] Patent Number: 4,676,238

[45] Date of Patent: Jun. 30, 1987

[54] SECOND STAGE AIR REGULATOR FOR UNDERWATER BREATHING

[76] Inventors: Robert H. Wetzel, 5560 Ben Alder; William W. Lidyoff, 5508 Ben Alder, both of Whittier, Calif. 90601

[21] Appl. No.: 658,784

[22] Filed: Oct. 9, 1984

[51] Int. Cl.[4] ..... A62B 7/04

[52] U.S. Cl. ..... 128/204.26; 128/912

[58] Field of Search ..... 128/204.26, 204.27, 128/207.16, 912, 202.27; 285/184

[56] References Cited

U.S. PATENT DOCUMENTS

| | | | |
|---|---|---|---|
| 2,581,047 | 1/1952 | Salmond et al. | 285/184 |
| 3,224,444 | 12/1965 | Dempster | 128/204.26 |
| 3,570,808 | 3/1971 | Wrenn | 128/202.27 |
| 3,762,746 | 10/1973 | Amada | 285/184 |
| 3,991,785 | 11/1976 | Trinkwalder, Jr. | 128/204.26 |
| 4,002,166 | 1/1977 | Oliver | 128/204.26 |

FOREIGN PATENT DOCUMENTS

| | | | |
|---|---|---|---|
| 692698 | 8/1965 | Italy | 128/207.16 |

*Primary Examiner*—Henry J. Recla

*Attorney, Agent, or Firm*—Edgar W. Averill, Jr.

[57] ABSTRACT

An improved in-line, downstream-demand, second-stage air regulator for underwater breathing apparatus. The regulator has an elongated body having the flexible air supply hose affixed at one end and the mouth affixed at the other end in line with the air supply hose. The device is particularly adaptable for use as an auxiliary supply source. It is activated by a diaphragm located in the side of the body and the exhaust valve preferably exhausts the air at the end of the regulator body adjacent the air supply hose.

8 Claims, 11 Drawing Figures

SECOND STAGE AIR REGULATOR FOR UNDERWATER BREATHING

BACKGROUND OF THE INVENTION

The field of the invention is underwater breathing apparatus and the invention relates more specifically to second-stage breathing regulators for use as auxiliary supply sources.

All prior art single hose regulators share a common configuration regardless of demand valve design. That is, the mouthpiece outlet is at right angles to the main valve and hose assembly of the regulator. While such design is convenient for use as the primary second-stage regulator, it is far less convenient for use in an emergency as an auxiliary regulator. It is prudent to carry an auxiliary regulator in case of a malfunction of the primary second-stage regulator or when needed by a fellow diver in case of malfunction of his air supply system. For such uses, it is highly advantageous for the mouthpiece to be in line with the air supply hose so that the auxiliary unit can be given to the diver in trouble even though he is trapped in a shipwreck, cave or other confined location. Because of the very great limitation of time and the possibility of a certain element of panic particularly in locations where the visibility is limited, it is advantageous for the diver providing the auxiliary regulator to be able to place the unit adjacent the mouth of the diver requiring it so that it may be put into use as quickly as possible.

Another disadvantage of the prior art design where the mouthpiece is at right angles to the main valve and hose assembly relates to the propensity of such regulators to become entangled in underwater vegetation and rocks due to their irregular shape. Because an auxiliary unit is designed to be hanging from an octopus assembly, it is very beneficial for a unit to be streamlined and have a reduced tendency to become entangled or filled with sand while dragging behind the diver on the bottom. The right angle design tends to fill with debris, and therefore when needed in an emergency may be deficient.

Many regulators are connected to the air hose by a fitting which provides an angle between the air supply hose and the regulator. Typically, a 90 degree el is provided which can also lead to an obvious entanglement problem when used as an auxiliary regulator.

SUMMARY OF THE INVENTION

It is thus an object of the present invention to provide an improved in-line downstream-demand second-stage air regulator having a minimum tendency to entangle or become fouled, while at the same time having a maximum ease of use in an emergency environment.

The present invention is for an improved in-line downstream-demand second-stage air regulator of the type having a flexible air hose affixed thereto for supplying air, a diaphragm activated valve assembly and a mouth piece. The improvement comprises an elongated regulator body defining an air chamber and having the flexible air supply hose affixed at the first end thereof. The mouthpiece of the regulator is affixed to the body at the second end so that the mouthpiece is in line with the air supply hose. Diaphragm means are affixed over an opening in the side of the regulator body. A low pressure air valve assembly means is held within the regulator body and a source of inlet air is provided to the valve assembly from the air supply hose. Actuating lever means are affixed to the low pressure air valve assembly at one end and positioned so that inward movement of the diaphragm means moves the actuating lever means thereby opening the main valve of the low pressure air valve assembly causing air to flow from the air supply hose through the elongated regulator body and out through the mouthpiece. One-way exhaust valve means are held by the regulator body and direct the flow of air out of the flow chamber and prevents the flow of water into the flow chamber. Preferably, the exhaust valve means has a plurality of exhaust ports positioned at the first end of the regulator body around the position of attachment of the air supply hose. Also, preferably, an aspiration tube directs air from the air valve assembly through a portion of the flow chamber terminating in the flow chamber near the mouthpiece assembly. A swivel having two parts, each part having a 45 degree angled face, is attached between the regulator and the air supply hose and permits the air supply hose to be moved from any angle between 90 degrees and 180 degrees with respect to the regulator body. The swivel has a cylindrical extension having first and second annular grooves formed in its outer surface and the cylindrical extension extends at right angles with respect to one of the 45 degree angled faces. An opening in the second of the 45 degree angled faces is slightly larger than the cylindrical extension and is also positioned at 90 degrees with respect to the second 45 degree angled face. An 0-ring is held in one of the grooves of the cylindrical extension and a holding protrusion is held by the second member and protrudes into the other groove of the cylindrical extension holding the two 45 degree angled faces together.

DESCRIPTION OF THE PREFERRED EMBODIMENTS

Figure 1:
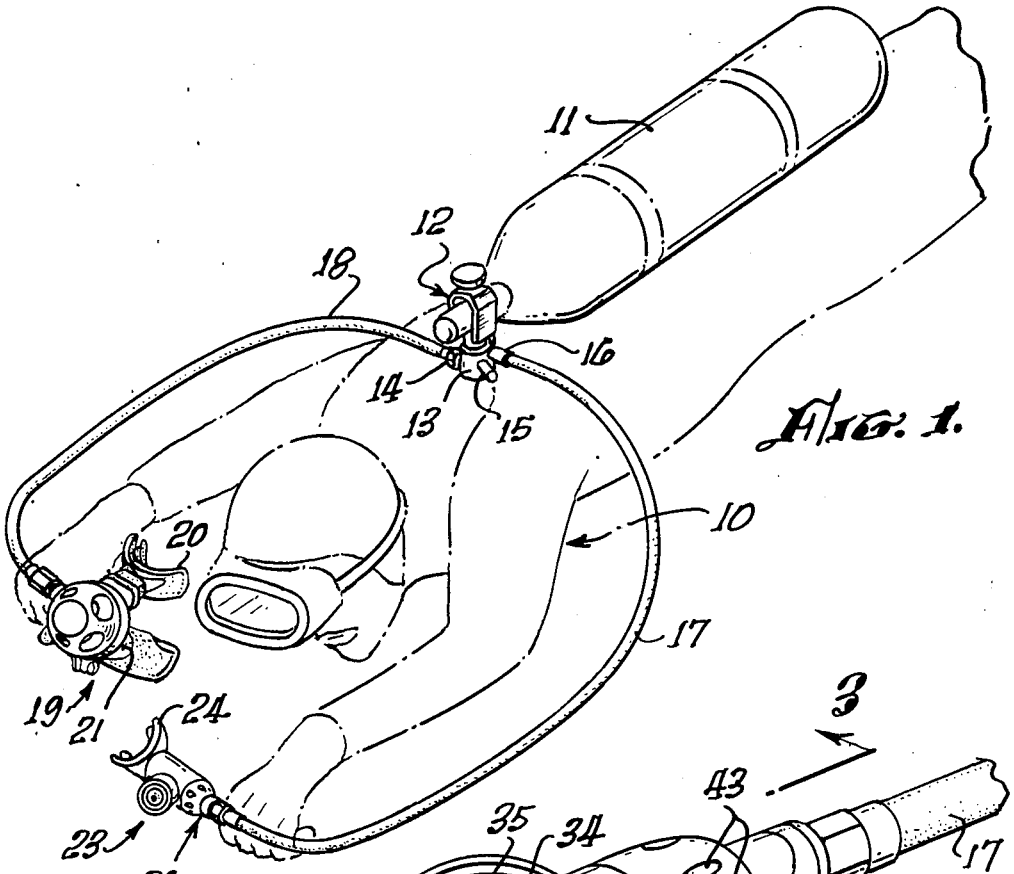
FIG. 1 is a perspective view showing an underwater diver having a high pressure air cylinder, a first stage regulator, a prior art second stage regulator and the regulator of the present invention.
Figure 2:
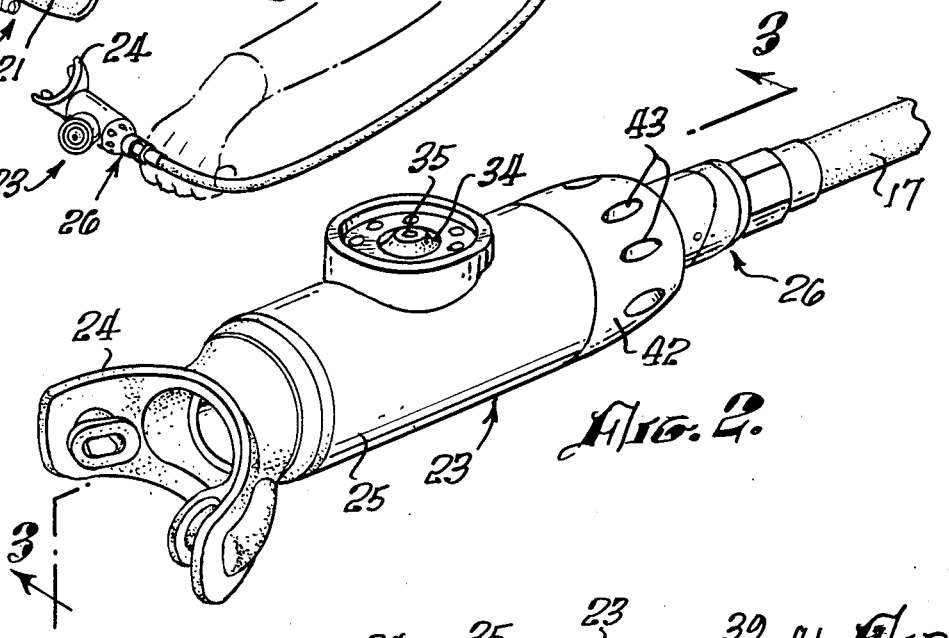
FIG. 2 is a perspective view of the regulator of the present invention affixed to a flexible air hose.

A diver 10 is shown in perspective view in FIG. 1 and has a high pressure air cylinder 11 strapped to his back. Air cylinder 11 has a first stage primary reduction regulator 12 of a conventional design which reduces the pressure from air cylinder 11 to a level appropriate for the second stage regulators. An octopus fitting 13 is connected to regulator 12 and has a plurality of outlets 14, 15 and 16. Flexible air hoses 17 and 18 are connected to outlets 16 and 14, respectively. A prior art air regulator 19 has a mouthpiece 20 which is oriented at a 90 degree angle with respect to the body 21 of the regulator and also with respect to the inlet air hose 18. The valve assembly of regulator 19 is positioned at the other end of body 21 with respect to air hose 18.

As mentioned above, this 90 degree configuration to the main valve and hose assembly has several disadvantages. If the valve is to be used in an emergency situation by another diver, it is important to achieve eye contact to assist in the transfer of the regulator from one diver to the other (his buddy). When transferring regulator 19 from one diver to another, the most convenient position is where the diver in trouble is to the left of or behind the donor diver which makes eye contact very difficult. Furthermore, when the diver in trouble is in a confined space such as a shipwreck, cave or other confining situation, there often is not enough room to position the regulator 19 so that it may be used by the confined diver in trouble.

The regulator of the present invention is attached to flexible air hose 17 and is indicated by reference character 23. As can be seen clearly in FIG. 1, regulator 23 may readily be transferred from diver 10 to a buddy diver even though the buddy diver is in a very confined position, and eye contact is greatly facilitated by the in-line design of the regulator 23 where the mouthpiece 24 is in line with the regulator body 25 and the flexible air hose 17. It can also be seen by comparing regulator 19 and regulator 23 in FIG. 1 that regulator 23 is far less likely to snare in water vegetation and rocks while dangling from the first stage regulator 12. Mouthpiece 20 of regulator 19 provides almost a hook configuration, whereas mouthpiece 24 can readily be pulled through even heavy vegetation without snagging. Furthermore, mouthpiece 20 could entrap sand or other debris when dangling from the first stage which is essentially impossible for mouthpiece 24 of the regulator 23 of the present invention.

Turning now to the details of construction of the regulator of the present invention, the air inlet hose 17 is connected through a swivel 26, which will be discussed further below, to the main valve assembly 27 which is positioned at one end of flow chamber 28 within regulator body 25. Main valve assembly 27 has a main valve stem 29 having a washer 30 which contacts the low pressure valve seat 31. Main valve return spring 32 urges the main valve stem 29 against low pressure valve seat 31. An actuating lever 33 holds main valve stem 29 away from valve seat 31 when it is tilted by movement of diaphragm 34. A push rod 35 is affixed to diaphragm 34 and rests on a flat area of actuating lever 33 to transmit the movement of diaphragm 34 to actuating lever 33. A similar valve design insofar as it relates to the actuating lever and main valve stem as shown in U.S. Pat. No. 3,991,785.

Main valve assembly 27 has a valve body 36 into which the air which passes through hose 17 and around valve seat 31 passes. An aspiration tube 37 is welded or otherwise affixed over an opening (not shown) in valve body 36 and conveys air from the interior of valve body 36 through the flow chamber 28 to its terminus 38. Terminus 38 is positioned at the inlet of the mouthpiece assembly 24 and thus the flow of air out of valve body 36 does not interfere with the operation of diaphragm 34.

Figure 3:
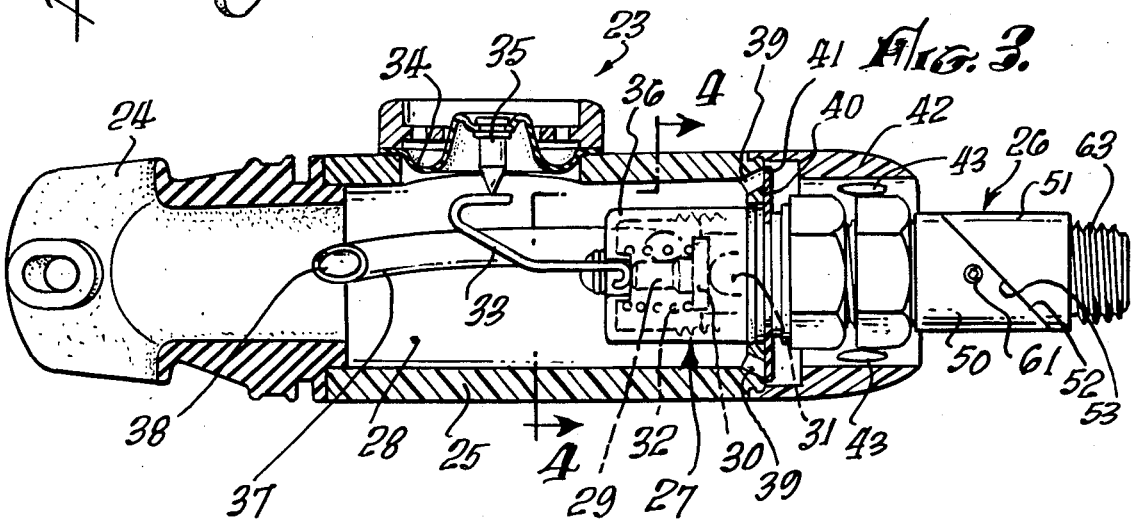
FIG. 3 is an enlarged cross-sectional view taken along line 3—3 of FIG. 2.
Figure 4:
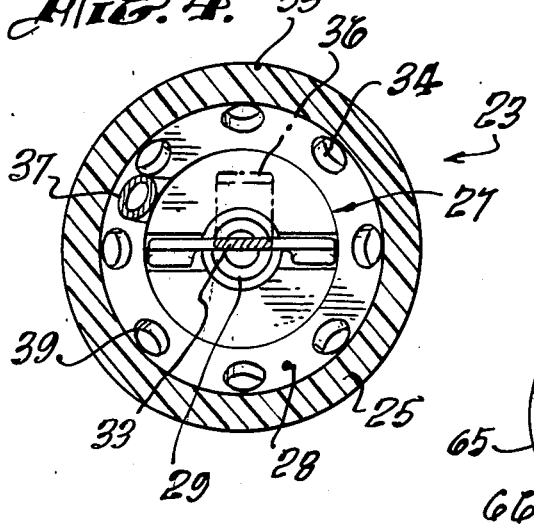
FIG. 4 is an enlarged cross-sectional view taken along line 4—4 of FIG. 3.
Figure 5:
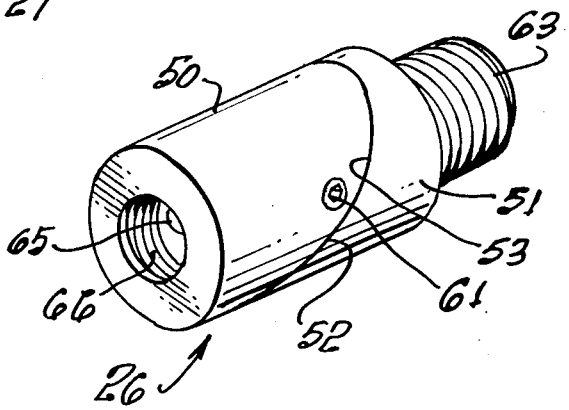
FIG. 5 is an enlarged perspective view of the swivel of the regulator of the present invention.
Figure 6:
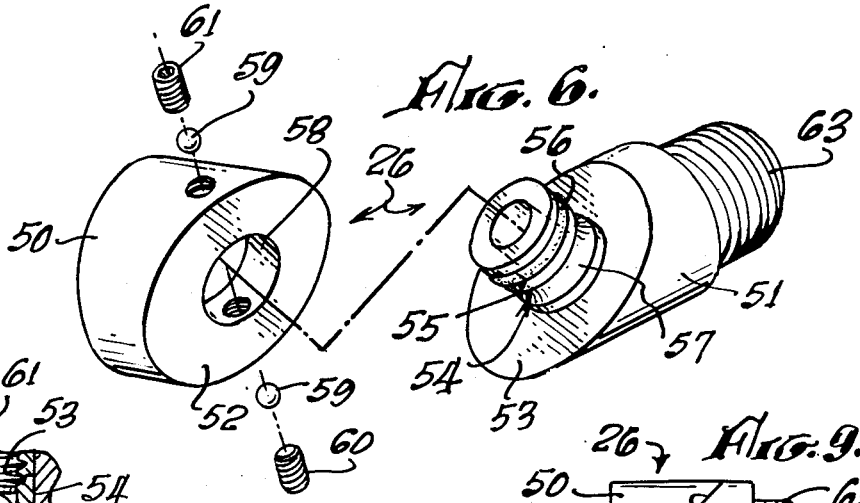
FIG. 6 is a perspective exploded view of the swivel of FIG. 5.
Figure 8:
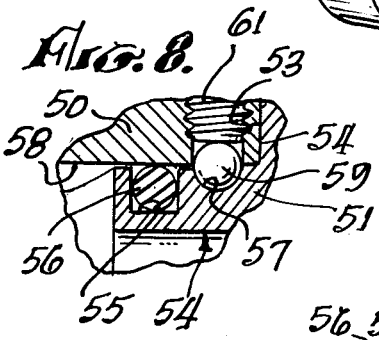
FIG. 8 is an enlarged fragmentary cross-sectional view of the holding means of the swivel of FIG. 5.

Diaphragm 34 is shown in its relaxed configuration in FIG. 3. When the user inhales on mouthpiece assembly 24, the pressure within flow chamber 28 is reduced causing diaphragm 34 to move inwardly with respect to regulator body 25. This causes push rod 35 to move actuating level 33 downwardly which in turn pulls main valve stem 29 away from the low pressure valve seat 31 causing air to flow into flow chamber 28 through aspiration tube 37. When the diver stops breathing inwardly diaphragm 34 returns to the position shown in FIG. 3 stopping the flow of air. An exhaust valve then opens to permit the exhaling of air through flow chamber 28 as more particularly discussed below.

A plurality of circular exhaust ports 39 are drilled or otherwise formed in the air inlet end of regulator body 25. These ports extend from the flow chamber 28 about the periphery of the valve body 36 and have their other end in a flat surface 40 of the air inlet end of regulator body 25. An exhaust diaphragm or flap 41 is held against flat surface 40 and permits air to flow outwardly from flow chamber 28 but prevents the flow of water into chamber 28. A cover 42, having a plurality of openings 43, is screwed or otherwise held onto regulator body 25 and permits the free movement of flap 41 while at the same time protecting it from opening by contact with other objects.

The location and design of the exhaust ports of the regulator of the present invention constitute an important feature thereof. As the diver stops inhaling, the pressure in the flow chamber equalizes and main valve return spring urges the actuating lever and diaphragm to its relaxed position closing off the flow of inlet air. This requires no effort on the part of the diver. Once the diver begins to exhale, a very slight increase in air pressure inside the flow chamber 28 causes exhaust flap 41 to move outwardly, exhausting the air and also exhausting any water that might have entered chamber 28.

Typically in prior art units, the exhaust valve is positioned below the mouthpiece at the lower rear of the flow chamber. Such a design, for instance, is shown in U.S. Pat. Nos. 3,329,158 and 3,348,540. Such a position allows expired air to leave the flow chamber for the next inhalation, and also any water in the chamber can be purged by virtue of the position of the exhaust valve at the lowest part of the chamber when the diver is in normal swimming position. Exhaled air displaces water in the flow body forcing it through the exhaust valve ports and into the surrounding water. However, placing the exhaust valve under the mouthpiece on the wall of the unit of the present invention would not guarantee that the unit would be used in a position where this position would always be downwardly. If the regulator were to be turned to a position in which the exhaust port faced upward toward the surface, the effect would be to allow air supply by the unit's valve assembly to escape into the surrounding water through the upturned exhaust port. Furthermore, such an upturned unit would fill with water and become almost useless as a safety device.

Some prior art regulator designs placed the exhaust port in line with the supply hose on the opposite end of the flow chamber. Two such devices are shown in U.S. Pat. Nos. 4,219,017 and 4,266,538. Of course, both units also have the mouthpiece at right angles to the air supply and are thus more likely to be snared, caught or fouled, but they do have the advantage of being able to be swiveled so that one diver may remove the valve from his mouth and insert it into his buddy's mouth while maintaining eye to eye contact. However, if the supply hose and regulator were in a position that places the exhaust valve facing upwardly, it becomes nearly impossible to adequately purge water from the flow chamber.

The exhaust valve comprising exhaust ports 39, flat surface 40 and exhaust flap 41 is positioned on the end of the flow chamber opposite the mouthpiece. Since the diameter of the flow chamber is much greater than the outside diameter of the connecting nut, only a small percentage of the end area of the flow chamber is used. This flat surface 40 completely encircles the air inlet fitting, and water is now allowed to pass out of the flow chamber around the supply hose readily exhausting water from the chamber. The result is the unit which provides an optimum degree of safety for auxiliary use.

Another feature of the present invention relates to the swivel indicated generally by reference character 26. The details of construction of the swivel are shown in FIGS. 5 through 8 where it can be seen that the swivel has two elongated members 50 and 51, each of which have a planar 45 degree face 52 and 53, respectively. A generally cylindrical extension 54 is positioned normal to face 53 and has an annular groove 55 (see FIG. 8) which contains an 0-ring 56. A groove 57 is used to hold the cylindrical extension 54 in the opening of member 50. Opening 58 is also formed normal to the surface 52 of member 50 and a pair of ballbearings 59 and 59*a* are held in groove 57 by a pair of Allen screws 60 and 61.

Figure 9A:
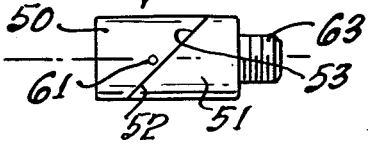
FIG. 9A is a reduced side view of the swivel of FIG. 5 in a straightened configuration.
Figure 7:
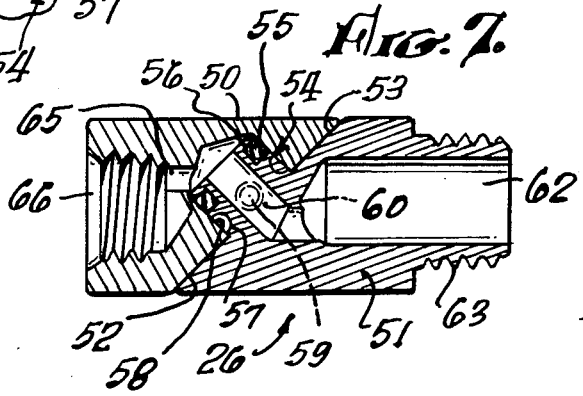
FIG. 7 is a cross-sectional view of the swivel of FIG. 5.
Figure 9B:
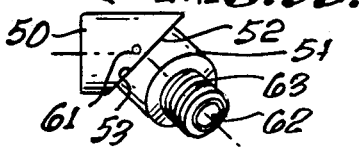
FIG. 9B is a reduced side view of the swivel of FIG. 5 in a 45 degree configuration.
Figure 9C:
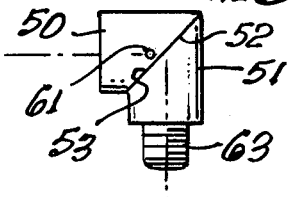
FIG. 9C is a reduced side view of the swivel of FIG. 5 in a 90 degree configuration.

The assembled swivel is shown in FIG. 7 in its in-line configuration. Air can flow through the opening 62 of the threaded nipple 63 into a 45 degree angled port into the interior of member 50. A port 65 conveys air into the threaded outlet 66 and into the air supply fittings of regulator 23. However, as shown in FIGS. 9A, 9B and 9C, member 51 can be rotated about its cylindrical extension 54 to provide any angle between 180 degrees shown in FIG. 9A to 90 degrees shown in FIG. 9C. A 45 degree configuration is shown in FIG. 9B. The construction is such that the swivel may be readily turned and thus tends to straighten out when dragged behind the diver. It, therefore, provides a maximum of safety, minimizing the possibility of entanglement.

While a ballbearing and Allen screw arrangement is shown in the drawings, other holding means may be utilized. For instance, a pin which is tangential to opening 58 could be used to secure cylindrical extension 54 in opening 58. Furthermore, while the O-ring 56 is shown near the end of extension 54, it could be placed nearer face 53, although this would also require a watertight ceiling of the holding means such as Allen screw 61 and ballbearing 59.

The design of the present regulator provides an optimum combination of ease of use in emergency situations combined with a minimum tendency to foul or snag. The diver may use it in any position safely without needing to position himself according to the constraints dictated by the prior art regulators.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. In an in-line, downstream-demand, second-stage air regulator of the type having flexible air hose affixed thereto for supplying air through a diaphragm activated valve assembly to a mouthpiece, wherein the improvement comprises:

an elongated regulator body defining an interior air chamber, said body having the flexible air supply hose affixed thereto at the first end of said body and the mouthpiece affixed to said body at the second end thereof so that the mouthpiece is axially in line with the air supply hose;

diaphragm means affixed over an opening in the side of said regulator body;

low pressure air valve assebly means including a main valve, said assembly being affixed to said regulator body within said body and adjacent the end at which the air supply hose is affixed, said valve assembly means having an inlet connected to said air supply hose and an outlet said valve assembly means being operated by the movement of its main valve;

an aspiration tube affixed at one end to the outlet of said low pressure air valve assembly within the regulator body and passing through the interior air chamber of said regulator body, past said diaphragm and terminating in said regulator body near the mouthpiece thereof, said aspiration tube being entirely within said regulator body;

actuating lever means affixed to said low pressure air valve assembly means at one end and positioned so that inward movement of said diaphragm means moves said actuating lever means thereby opening said main valve of said low pressure air valve assembly causing air to flow from said air supply hose, through said elongated regulator body and out through said mouthpiece; and one-way exhaust valve means affixed to said regulator body.

2. The improved, in-line, downstream-demand, second-stage air regulator of claim 1 wherein said exhaust valve means comprises flexible, one-way exhaust valve means comprising a plurality of exhaust ports through said regulator body at the first end thereof surrounding the position of attachment of the air supply hose on said body and flexible exhaust valve flap means affixed over said exhaust ports to permit the flow of air out of said exhaust ports and to prevent the flow of water into the regulator body.

3. The improved, in-line, downstream-demand, second-stage air regulator of claim 1 wherein said regulator body is generally cylindrical.

4. The improved, in-line, downstream-demand, second-stage air regulator of claim 1 further including swivel means attached to the regulator body at the first end thereof and having the air supply hose affixed to the other end thereof.

5. The improved, in-line, downstream-demand, second-stage air regulator of claim 4 wherein said swivel means comprises first and second elongated members, each of said elongated members having a 45 degree angled face on one end, the first of said members having a cylindrical extension positioned normal to its 45 degree angled face, said cylindrical extension having first and second annular grooves formed in its outer surface the first of said annular grooves having O-ring means held therein;

the second of said elongated members having a cylindrical opening having its central axis positioned normal to the 45 degree angled face thereof, said cylindrical opening being slightly larger than the cylindrical extension of the first elongated member and said cylindrical opening having at least one protrusion extending into said cylindrical opening positioned to capture the second annular groove of the cylindrical extension.

6. The improved, in-line, downstream-demand, second-stage air regulator of claim 5 wherein said protrusion comprises ball bearing means.

7. The improved, in-line, downstream-demand, second-stage air regulator of claim 6 wherein there are two ball bearing means.

8. The improved, in-line, downstream-demand, second-stage air regulator of claim 7 wherein the first of said annular grooves of said cylindrical extension is nearer the end of said cylindrical extension.

* * * * *